United States Patent [19]

Echols et al.

[11] Patent Number: 4,664,178

[45] Date of Patent: May 12, 1987

[54] ONE-PIECE REMOVABLE TUBE LANE BLOCKING DEVICE FOR NUCLEAR STEAM GENERATOR

[75] Inventors: John D. Echols, Wilkinsburg; Robert M. Wilson, Plum Borough, both of Pa.

[73] Assignee: Westinghouse Electric Corp., Pittsburgh, Pa.

[21] Appl. No.: 793,041

[22] Filed: Oct. 30, 1985

[51] Int. Cl.[4] ..... F28D 1/06; F28F 9/22

[52] U.S. Cl. ..... 165/72; 165/160; 122/382

[58] Field of Search ..... 165/72, 159, 160, 161; 122/382-389, 406 B

[56] References Cited

U.S. PATENT DOCUMENTS

| | | | |
|---|---|---|---|
| 912,067 | 2/1909 | Brown . | |
| 3,174,463 | 3/1965 | Reagan . | |
| 4,047,562 | 9/1977 | Weber | 165/72 X |
| 4,105,065 | 8/1978 | Chirico . | |
| 4,407,236 | 10/1983 | Schukei et al. . | |
| 4,508,063 | 4/1985 | Monne . | |
| 4,566,406 | 1/1986 | Appleman | 122/383 X |

*Primary Examiner*—Albert W. Davis, Jr.
*Assistant Examiner*—Richard R. Cole

[57] ABSTRACT

A one-piece removable tube lane block includes an L-shaped angle bar, having one end thereof fixed to the closed end of a cylindrical sleeve and extending axially outwardly therefrom. The outer end of the sleeve has a radially outwardly extending annular retaining flange for engagement with the vessel wall at the outer end of the handhole. The blocking portion is dimensioned to be insertable through the handhole and into the tube lane to a use position with the distal leg of the L-shaped bar disposed perpendicular to the tube sheet and with the mounting sleeve disposed in the handhole and held in place therein by set screws extending radially outwardly through the sleeve.

16 Claims, 10 Drawing Figures

ONE-PIECE REMOVABLE TUBE LANE BLOCKING DEVICE FOR NUCLEAR STEAM GENERATOR

BACKGROUND OF THE INVENTION

1. Field of the Invention

The present invention relates to heat exchange vessels, such as nuclear steam generating vessels, and particularly relates to means for controlling the flow of heat exchange fluid along the outsides of a bundle of heat exchange tubes.

2. Description of the Prior Art

A typical nuclear steam generator comprises a vertically oriented shell or vessel and a plurality of inverted U-shaped tubes disposed in the shell so as to form a tube bundle. Each tube has a pair of elongated vertical portions interconnected at the upper end by a curved bight portion, so that the vertical portions of each tube straddle a center lane or passage through the tube bundle. A tube sheet supports the vertical portions of the tubes at their lower ends. The vertical tube portions on one side of the center lane communicate with a primary fluid inlet header and those on the other side of the center lane communicate with a primary fluid outlet header beneath the tube sheet. The steam generator also comprises a cylindrical wrapper sheet disposed between the tube bundle and the shell to form an annular chamber with the internal shell.

The primary fluid, having been heated by circulation through the reactor core, enters the steam generator through the primary fluid inlet header, is transmitted through the tube bundle and out the primary fluid outlet header. At the same time, a secondary fluid or feedwater is circulated around the tubes above the tube sheet in heat transfer relationship with the outside of the tubes, so that a portion of the feedwater is converted to steam, which is then circulated through standard electrical generating equipment. More particularly, the feedwater is conducted down the annular chamber along the outside of the wrapper to the tube sheet, and then upwardly among the tubes inside the wrapper.

The feedwater contains particles of material, mainly in the form of iron oxides and copper compounds, along with traces of other metals, which tend to settle out of the feedwater onto the tube sheet in those areas of the tube sheet where the velocity of lateral flow across the tube sheet is insufficient to prevent settling. This settling is harmful because it creates buildups of sludge deposits which provide sites for concentration of corrosive agents at the tube walls that result in tube corrosion. Since there are no tubes in the center lane, it is desirable to minimize flow along the center lane so as to increase lateral flow through the tube bundle, thereby reducing the size of the area on the tube sheet where the velocity of lateral flow is insufficient to prevent sludge settling.

To this end, some steam generator vessels have been provided with built-in tube lane blocks in the center lane to inhibit the flow of feedwater therealong. However, such built-in tube lane blocks have only been provided in nuclear steam generators of relatively recent vintage.

In the case of earlier steam generator vessels, it has been necessary to retrofit them with removable tube lane blocks. These blocks had to be inserted through available handholes in the vessel wall a slight distance above the tube sheet, the handholes typically being aligned with the center lane. The tube lane blocks are inserted in sections small enough to fit through the handhole, the blocks containing tabs adapted to interfit with saddles mounted on the tube sheet, the parts being inserted through a cutout in the wrapper. Split cover halves are then installed to cover the wrapper cutout, these cover halves being disposed in notches in the blocks to inhibit vertical movement thereof. The split cover halves are then secured to a sleeve fitted in the handhole and held in place by set screws. The entire assembly is then sealed by the handhole cover.

This arrangement provides effective tube lane blockage, but is extremely time consuming and expensive to install and to disassemble. Whenever it is desired to provide sludge lancing or other maintenance operations, such as foreign object search and retrieval, it is necessary to disassemble the tube block assembly by removing the sleeve and split cover halves one piece at a time, and then lifting the blocks from their notches and moving them out of the way. Considerable man/rem exposure is entailed. Furthermore, there is significant possibility that loose parts may be left in the generator. Installation and removal has to be done very carefully in order to avoid damaging the tubes.

SUMMARY OF THE INVENTION

It is a general object of this invention to provide an improved tube lane blocking apparatus for a heat exchanger vessel which avoids the disadvantages of prior devices while affording additional operating advantages.

An important object of the present invention is the provision of a tube lane blocking apparatus of the type set forth which is easily mountable in and removable from the heat exchanger vessel.

In connection with the foregoing object, it is another object of the invention to provide a tube lane blocking apparatus of the type set forth which is of integral construction so as to be mountable and removable as a unit.

Still another object of the invention is the provision of a tube lane blocking apparatus of the type set forth which is of simple and economical construction.

Yet another object of the invention is the provision of a tube lane blocking apparatus of the type set forth which minimizes the chance of loose parts and tube damage during installation and removal.

These and other objects of the invention are attained by providing removable apparatus for blocking the flow of heat exchange fluid in a free center lane through a tube bundle above a tube sheet in a heat exchanger vessel having a handhole aligned with the center lane, the apparatus comprising: a blocking portion insertable through the handhole and into the center lane, and a mounting portion connected to the blocking portion and fixedly mountable in the handhole in a mounted condition, the blocking portion and the mounting portion being movable as a unit between a withdrawn position disposed completely outside the heat exchanger vessel and a use position with the mounting portion in the mounted condition and with the blocking portion disposed in a blocking orientation in the center lane for inhibiting fluid flow along the center lane.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
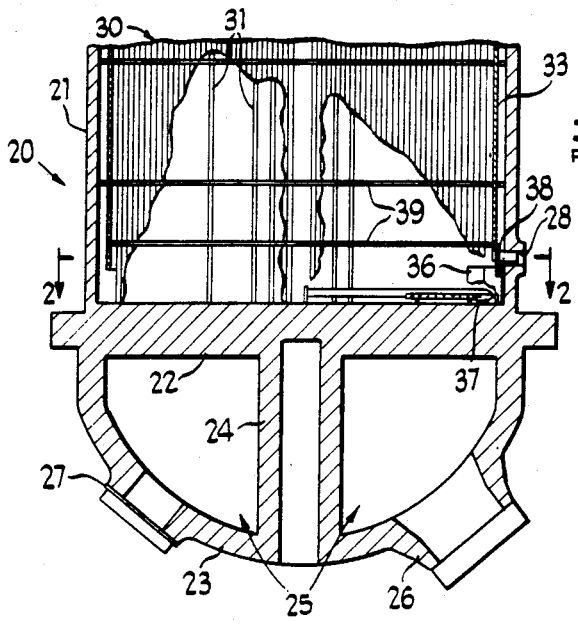
Fig 1 PRIOR ART
FIG. 1 is a fragmentary, vertical sectional view of a nuclear steam generator vessel, illustrating tube lane blocking devices in accordance with a prior art construction.
Figure 5:
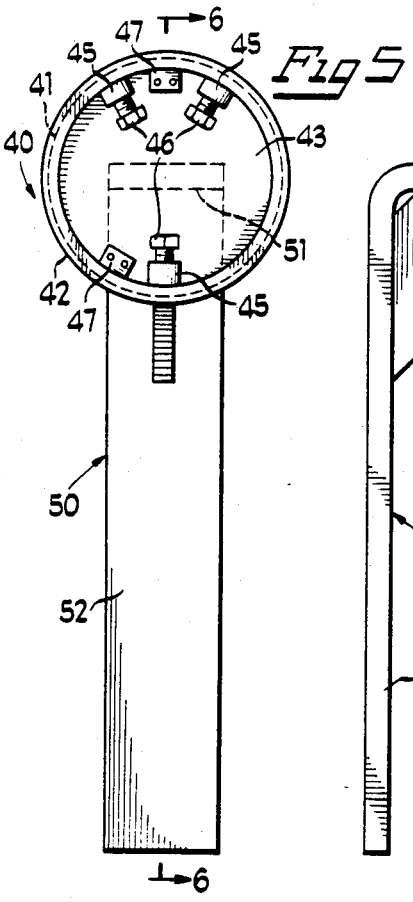
FIG. 5 is a slightly enlarged front elevational view of the tube lane blocking device of FIG. 4.
Figure 6:
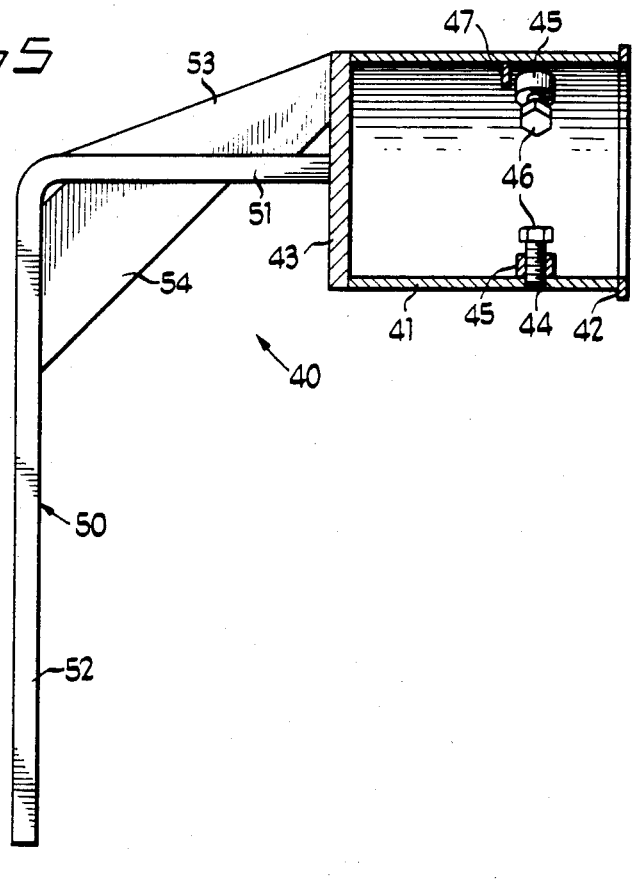
FIG. 6 is a view in vertical section taken along the line 6—6 in FIG. 5.
Figure 2:
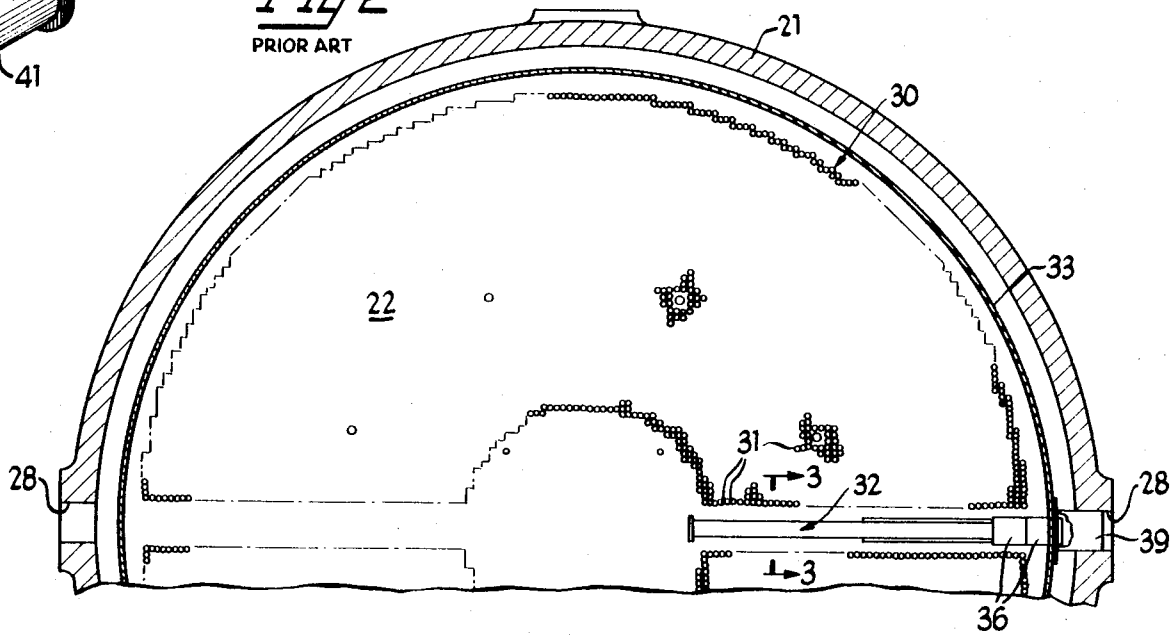
Fig 2 PRIOR ART
FIG. 2 is an enlarged fragmentary view in horizontal section taken along the line 2—2 in FIG. 1, and further illustrating the prior art tube lane blocking devices.
Figure 4:
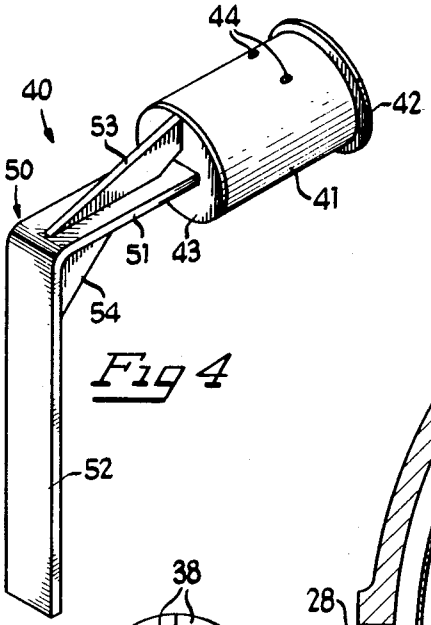
FIG. 4 is a perspective view of a tube lane blocking device constructed in accordance with and embodying the features of the present invention.
Figure 3:
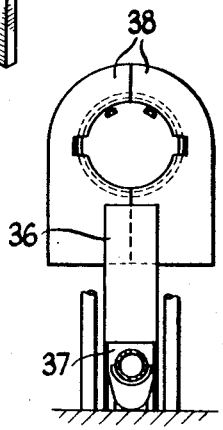
Fig 3 PRIOR ART
FIG. 3 is a fragmentary view in vertical section taken along the line 3—3 in FIG. 2.

Referring to FIGS. 1 and 2, there is illustrated a nuclear steam generator vessel, generally designated by the numeral 20, which includes an elongated, generally cylindrical side wall 21. Extending across and closing the vessel 20 adjacent to the lower end thereof is a circular tube sheet 22. The vessel 20 has a generally hemispherical lower end 23 extending beneath the tube sheet 22 and connected thereto by a center stay 24. A dividing wall (not shown) divides the area between the tube sheet 22 and the lower end 23 into two plenum chambers or headers 25, each provided with a nozzle 26 (one shown) and a manway 27 (one shown). The nozzles 26 are respectively coupled by conduits (not shown) to an associated nuclear reactor. The manways 27 have removable covers for providing access to the headers 25. Formed in the side wall 21, a slight distance above the tube sheet 22, are two or more handholes 28 provided with removable covers (not shown) for affording access to the interior of the vessel 20 above the tube sheet 22. For purposes of the present invention, each handhole 28 is provided at its outer end with one or more counterbores 29 (see FIGS. 7–9).

Disposed in the vessel 20 above the tube sheet 22 is a tube bundle 30 comprising a plurality of inverted U-shaped tubes 31, the legs of each tube 31 straddling a center tube lane 32 which extends diametrically across the tube sheet 22, parallel to the axis of at least two of the handholes 28. Each tube 31 has the two legs thereof communicating respectively with the headers 25 through openings (not shown) in the tube sheet 22. A cylindrical wrapper 33 encircles the tube bundle 30 coaxially with the side wall 21 and spaced a slight distance inwardly of the inner surface thereof. The wrapper 33 has a cutout 34 in its lower edge adjacent to and in alignment with one of the handholes 28. A blowdown pipe 35 may be provided along the center tube lane 32 just above the tube sheet 22 (see FIGS. 7–10).

In operation, primary fluid from the reactor core is circulated into an input one of the headers 25, through the tube bundle 30, and then outwardly through the outlet one of the headers 25 and back to the reactor core. Secondary feedwater is circulated in the vessel 20 above the tube sheet 22 in heat-exchange relationship with the tube bundle 30. More particularly, the feedwater circulates downwardly through the annular channel between the vessel side wall 21 and the wrapper 33, impinges on the tube sheet 22 and then circulates upwardly through the tube bundle 30, all in a known manner.

The flow velocity of the feedwater laterally across the tube sheet 22 may vary at different regions of the tube sheet 22. This flow velocity, if sufficient, can prevent the buildup of sludge from the settling of deposits from the feedwater. Thus, in order to maximize the lateral flow velocity in the regions of the tube bundle 30, it is desirable to minimize flow velocity in the center tube lane 32 where there are no tubes. To this end, prior steam generating vessels have utilized blocking devices in the center tube lane 32 to inhibit the flow of feedwater therealong. In one such prior art arrangement, tube lane blocks 36 are mounted in the center tube lane 32, being laterally retained in place by a saddle 37 mounted on the tube sheet 22 and being vertically retained in place by split cover halves 38 received in notches in one of the tube lane blocks 36. The split cover halves 38 are fixedly secured, as by welding or bolting, to a tubular sleeve 39 which is received in the associated handhole 28 and secured in place, as by set screws. This multipart arrangement is characterized by relatively difficult and time-consuming installation, necessitating significant man/rem exposure.

Furthermore, for certain maintenance operations, such as sludge lancing and foreign object search and retrieval, the prior tube lane blocking apparatus must be removed to permit access to the center tube lane 32 and to the channel between the wrapper 33 and the vessel side wall 21. This necessitates removal of the sleeve 39 and the split cover halves 38, and disengagement of the tube lane blocks 36 so that they can be moved out of the way along the center tube lane 32. This disassembly is a very time consuming procedure, resulting in considerable man/rem exposure.

Referring now in particular to FIGS. 4–10, the present invention provides an improved center tube lane blocking apparatus, generally designated by the numeral 40, which is characterized by simple and economical integral construction, so that it can be easily installed and removed as a unit. More particularly, the blocking apparatus 40 includes a tubular sleeve 41, which is similar to the prior art sleeve 39, but is provided with a radially outwardly extending annular retaining ring at its outer end, the inner end of the sleeve 41 being closed by a circular cover plate 43 which is secured in place, as by welding. Extending radially through the sleeve 41 are three internally threaded apertures 44, the axes of which lie in a common plane substantially perpendicular to the axis of the sleeve 41. Fixedly secured to the inner surface of the sleeve 41 and respectively communicating with the apertures 44 are three internally threaded bosses 45 for respectively receiving therein jack screws 46. Lock wire tabs 47 may also be provided on the inner surface of the tubular sleeve 41 for cooperation with lock wires (not shown) to retain the screws 46.

Integral with the cover plate 43 is a generally L-shaped blocking member 50, including a flat rectangular mounting leg 51 fixedly secured, as by welding to the cover plate 43, and a flat-rectangular blocking leg 52 disposed substantially perpendicular to the mounting leg 51. Preferably, a gusset plate 53 is provided between the mounting leg 51 and the cover plate 43, and a gusset plate 54 is provided between the mounting leg 51 and the blocking leg 52, all to rigidify the construction.

The blocking member 50 has a width slightly less than the width of the center tube lane 32, so as to be able to substantially block the tube lane 32 laterally, and has a length slightly less than the vertical distance between the axis of the handhole 28 and the tube sheet 22.

Figure 7:
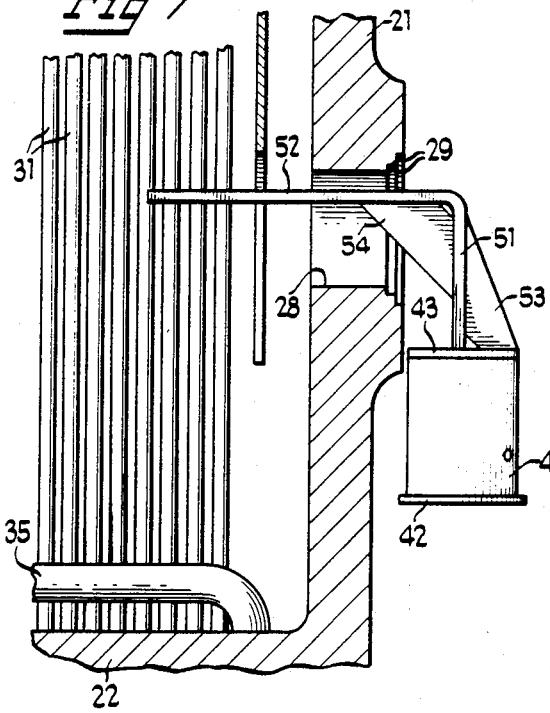
FIG. 7 is an enlarged, fragmentary view in vertical section of a portion of the steam generator vessel of FIG. 1, illustrating the initial step in mounting of the tube lane blocking device of FIG. 4.
Figure 8:
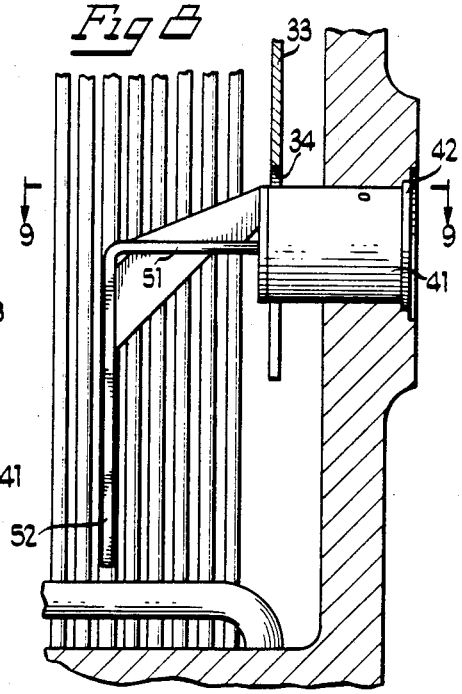
FIG. 8 is a view similar to FIG. 7, and illustrating the tube lane blocking device in its mounted condition.
Figure 9:
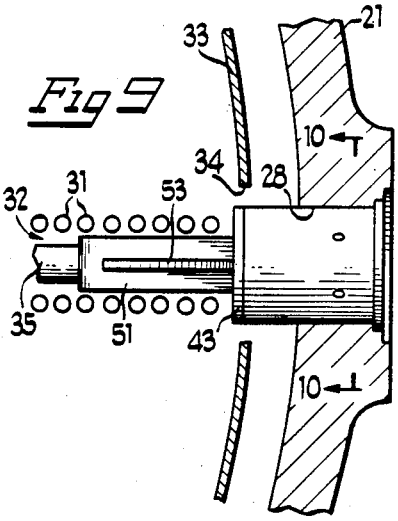
FIG. 9 is a fragmentary view in horizontal section taken along the line 9—9 in FIG. 8.
Figure 10:
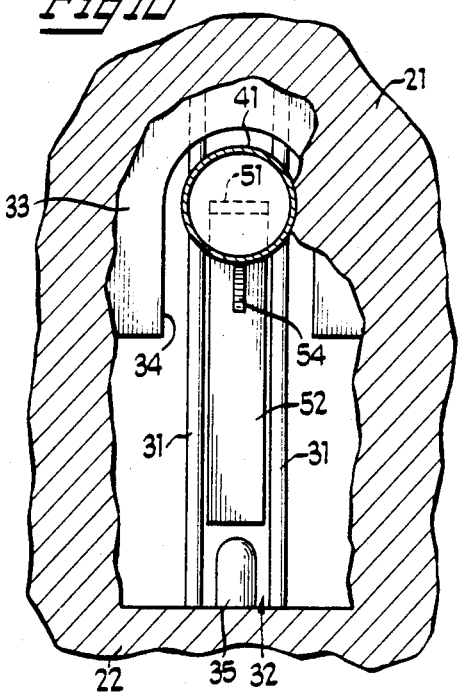
FIG. 10 is a fragmentary view in vertical section taken along the line 10—10 in FIG. 9.

In use, the blocking apparatus 40 is mounted in place by removing the handhole cover and inserting the distal end of the blocking leg 52 through the handhole 28, as illustrated in FIG. 7, the blocking leg 52 extending through the cutout 34 in the wrapper 33 and along the center tube lane 32. When the blocking leg 52 has been substantially fully inserted into the handhole 28, the blocking apparatus 40 is rotated 90° in a counterclockwise direction, as viewed in FIG. 7, while insertion is continued, to move the mounting leg 51 through the handhole 28 and insert the sleeve 41 into the handhole 28, the depth of insertion being limited by engagement of the retaining ring 42 in one of the counterbores 29 of the handhole 28, as illustrated in FIGS. 8–10. When thus disposed in its mounted condition, the blocking apparatus 40 is arranged with the blocking leg 52 disposed vertically in a blocking orientation, perpendicular to the tube sheet 22 and to the axis of the center tube lane 32. In this mounted condition, the distal or lower end of the blocking leg 52 terminates a slight distance above the tube sheet 22 to accommodate passage of the blowdown pipe 35 and the saddle 37 therebeneath. As can best be seen in FIGS. 8 and 10, in this mounted condition, the inner end of the sleeve 41 extends through the cutout 34 in the wrapper 33.

When the blocking apparatus 40 has thus been installed in its mounted condition, it is securely retained in that condition by screwing the jack screws 46 radially outwardly into engagement with the inner surface of the handhole 28, securely to lock the sleeve 41 in place. Because of the seating of the retaining ring 42 in the counterbore 29, no part of the blocking apparatus 40 projects outwardly from the handhole 28, thereby facilitating mounting in place of the handhole cover (not shown) for providing a fluid-tight closure of the handhole 28.

It will be appreciated, that when it is desired to remove the blocking apparatus 40, it is only necessary to remove the handhole cover and to loosen the jack screws 46, whereupon the entire blocking apparatus 40 can be removed, as a unit, from the vessel 20 by reversing the movements described above, rotating the blocking apparatus 40 about 90° clockwise to permit passage of the blocking member 50 through the handhole 28.

This simple installation and removal of a single piece in a substantially one-step operation can be accomplished quickly and easily with minimum man/rem exposure. Furthermore, it is a significant advantage of the invention that the blocking apparatus 40 can be easily and accurately installed with minimal risk of damage to the tubes 31 lining the center tube lane 32. Furthermore, since there are no attachments to be undone inside the steam generator vessel 20, there is little or no chance of loose parts being dislodged and left inside the vessel 20.

While the use of set screws or jack screws 46 has been disclosed for locking the blocking apparatus 40 in place in its mounted condition, it will be appreciated that other types of mounting arrangements might be used, if desired.

We claim as our invention:

1. Removable apparatus for blocking the flow of heat exchange fluid in a free center lane through a tube bundle above a tube sheet in a heat exchanger vessel having a handhole aligned with the center lane, said apparatus comprising: a blocking portion insertable through the handhole and into the center lane, and a mounting portion connected to said blocking portion and fixedly mountable in the handhole in a mounted condition, said blocking portion and said mounting portion being movable as a unit between a withdrawn position disposed completely outside the heat exchanger vessel and a use position with said mounting portion in said mounted condition and with said blocking portion disposed in a blocking orientation in the center lane for inhibiting fluid flow along the center lane.

2. The apparatus of claim 1, wherein said blocking portion is integral with said mounting portion.

3. The apparatus of claim 1, wherein said blocking portion includes a flat rectangular portion disposed substantially perpendicular to the tube sheet and spanning the center lane when said blocking portion is disposed in its blocking orientation.

4. The apparatus of claim 3, wherein said blocking portion includes an angle iron having a first leg connected to said mounting portion and a second leg comprising said flat rectangular portion and disposed perpendicular to said first leg.

5. The apparatus of claim 1, wherein no portion of said apparatus in said use position extends outwardly from the handhole.

6. The apparatus of claim 1, wherein said blocking portion in the blocking orientation thereof is disposed substantially perpendicular to the tube sheet and spaced a predetermined distance from the handhole.

7. The apparatus of claim 1, and further including reinforcing means fixedly securing said blocking portion to said mounting portion.

8. Removable apparatus for blocking the flow of heat exchange fluid in a free center lane through a tube bundle above a tube sheet in a heat exchanger vessel having a handhole aligned with the center lane, said apparatus comprising: a hollow cylindrical mounting member having a closed inner end adapted to be disposed in the handhole in a mounted condition and an open outer end, means fixedly securing said mounting member in said mounted condition, and blocking means connected to said closed inner end of said mounting member and adapted to be received through the handhole, said blocking means including a blocking member disposable in the center lane, said blocking means and said mounting member being movable as a unit between a withdrawn position disposed completely outside the heat exchanger vessel and a use position with said mounting member in said mounted condition and with said blocking member disposed in a blocking orientation substantially perpendicular to the tube sheet and substantially spanning the center lane for inhibiting the flow of fluid along the center lane.

9. The apparatus of claim 8, wherein said mounting member has an outer diameter only slightly less than the inner diameter of the handhole.

10. The apparatus of claim 8, wherein said mounting member includes an annular retaining ring extending radially outwardly therefrom and adapted for engagement with the heat exchanger vessel for limiting the depth of insertion of said mounting member in the handhole.

11. The apparatus of claim 10, wherein the vessel has a counterbore portion at the outer end of the handhole, said retaining ring being receivable in said counterbore portion.

12. The apparatus of claim 8, wherein said means for fixedly securing includes a set screw extending radially outwardly through said mounting member for engagement with the inner surface of the handhole.

13. The apparatus of claim 8, wherein no portion of said apparatus in the use position thereof extends outwardly from the handhole.

14. The apparatus of claim 8, wherein said mounting member is integral with said blocking means.

15. The apparatus of claim 14, wherein said blocking means includes an angle member having two perpendicular legs, one leg of which comprises a blocking member and the other leg of which is integral with said mounting member.

16. The apparatus of claim 15, wherein said blocking member is rectangular in shape.

* * * * *